US008517620B2

(12) United States Patent
Kanbara

(10) Patent No.: US 8,517,620 B2
(45) Date of Patent: Aug. 27, 2013

(54) GUIDE MEMBER FOR PRINTER HAVING PLURALITY OF GUIDE COLLARS

(75) Inventor: Takaaki Kanbara, Tomi (JP)

(73) Assignee: Mimaki Engineering Co., Ltd., Tomi (JP)

( * ) Notice: Subject to any disclaimer, the term of this patent is extended or adjusted under 35 U.S.C. 154(b) by 1188 days.

(21) Appl. No.: 12/061,559

(22) Filed: Apr. 2, 2008

(65) Prior Publication Data

US 2008/0253823 A1 Oct. 16, 2008

(30) Foreign Application Priority Data

Apr. 3, 2007 (JP) ..... 2007-097219

(51) Int. Cl.
*B41J 15/04* (2006.01)
*B41J 15/16* (2006.01)
*B65H 27/00* (2006.01)

(52) U.S. Cl.
USPC ..... 400/642; 400/641; 242/417.3; 242/615.1; 242/615.2; 347/104

(58) Field of Classification Search
CPC ..... B41J 15/046
USPC ..... 400/641, 642; 492/28, 39; 226/21, 226/39, 88, 168, 182, 185; 242/417.3, 615.1, 242/615.2; 101/228
IPC ..... B65H 23/32, 23/36, 23/032, 27/00
See application file for complete search history.

(56) References Cited

U.S. PATENT DOCUMENTS

| | | | | |
|---|---|---|---|---|
| 3,771,738 | A * | 11/1973 | Abbey | 242/419.5 |
| 5,818,487 | A * | 10/1998 | Yoshimura et al. | 347/104 |
| 6,364,247 | B1 * | 4/2002 | Polkinghorne | 242/615.11 |
| 6,427,941 | B1 * | 8/2002 | Hikita | 242/615.12 |
| 2003/0059240 | A1 * | 3/2003 | Takai et al. | 399/406 |
| 2004/0169326 | A1 * | 9/2004 | Nakano et al. | 271/121 |
| 2004/0183850 | A1 * | 9/2004 | Takeuchi et al. | 347/19 |
| 2007/0138739 | A1 * | 6/2007 | Van Soest | 271/273 |

FOREIGN PATENT DOCUMENTS

| | | | |
|---|---|---|---|
| JP | 07061667 | A * | 3/1995 |
| JP | 08333036 | A * | 12/1996 |
| JP | 2001171873 | A * | 6/2001 |
| JP | 2001310837 | A * | 11/2001 |
| JP | 2003-252491 | | 9/2003 |
| JP | 2004115971 | A * | 4/2004 |
| JP | 2004314565 | A * | 11/2004 |
| JP | 2005022178 | A * | 1/2005 |

* cited by examiner

*Primary Examiner* — Daniel J Colilla
(74) *Attorney, Agent, or Firm* — Dittavong Mori & Steiner, P.C.

(57) ABSTRACT

A printer includes a supporting member, a print head and a guide member. The supporting member is configured to support a sheet print medium on an upper surface of the supporting member. The print head is provided to print on the sheet print medium fed onto the upper surface of the supporting member. The guide member is configured to guide the sheet print medium to feed the sheet print medium onto the upper surface of the supporting member. The guide member includes at least one guide collar around which the sheet print medium is wound and a guide bar provided in the at least one guide collar so that the at least one guide collar is rotatable around the guide bar.

10 Claims, 4 Drawing Sheets

GUIDE MEMBER FOR PRINTER HAVING PLURALITY OF GUIDE COLLARS

CROSS-REFERENCE TO RELATED APPLICATIONS

The present application claims priority under 35 U.S.C. §119 to Japanese Patent Application No. 2007-097219, filed Apr. 3, 2007, entitled "Printer Apparatus." The contents of this application are incorporated herein by reference in their entirety.

BACKGROUND OF THE INVENTION

1. Field of the Invention

The present invention relates to a printer and a feeding apparatus for the printer.

2. Discussion of the Background

In a printer for printing on a sheet-like print medium, in order to improve the accuracy in feeding the print medium, it is known to place a guide member, which is formed in a cylindrical shape extending in the width direction of the print medium, in the way of feeding the print medium from a sheet supplying member to a print head, at a position capable of smoothly feeding the print medium to the print head. For example, JP-A-2003-252491 discloses such a printer. The contents of this publication are incorporated herein by reference in their entirety. Conventionally, a print medium is fed from a sheet supplying member to a print head by rotating a guide member 200 (see FIG. 5), which is formed in a cylindrical shape extending in the width direction for substantially the same length as the dimension in the width direction of the print medium and is rotatably disposed, regardless of the dimension in the width direction of the print medium even when the sheet-like print medium is large (for example, about 3 meters) in width.

Since the guide member 200 extends in the width direction for substantially the same length as the width of the print medium, however, twist and warpage are easily occurred in manufacturing the guide member 200 and an installation error is also easily caused in installing the guide member 200 to a printer because the guide member 200 is long in the width direction. Accordingly, when the guide member 200 is rotated with a state installed to the printer, the rotational trajectory of the periphery of the guide member 200 should be wavy as seen in the width direction so that the feeding distance of the print medium is hard to be constant. Therefore, there is such a problem that the accuracy in feeding the print medium is deteriorated.

SUMMARY OF THE INVENTION

According to one aspect of the present invention, a printer includes a supporting member, a print head and a guide member. The supporting member is configured to support a sheet print medium on an upper surface of the supporting member. The print head is provided to print on the sheet print medium fed onto the upper surface of the supporting member. The guide member is configured to guide the sheet print medium to feed the sheet print medium onto the upper surface of the supporting member. The guide member includes at least one guide collar around which the sheet print medium is wound and a guide bar provided in the at least one guide collar so that the at least one guide collar is rotatable around the guide bar.

According to another aspect of the present invention, a feeding apparatus for a printer includes a guide member which is configured to guide a sheet print medium to feed the sheet print medium onto an upper surface of a supporting member on which a print head is configured to print. The guide member includes at least one guide collar around which the sheet print medium is wound and a guide bar provided in the at least one guide collar so that the at least one guide collar is rotatable around the guide bar.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
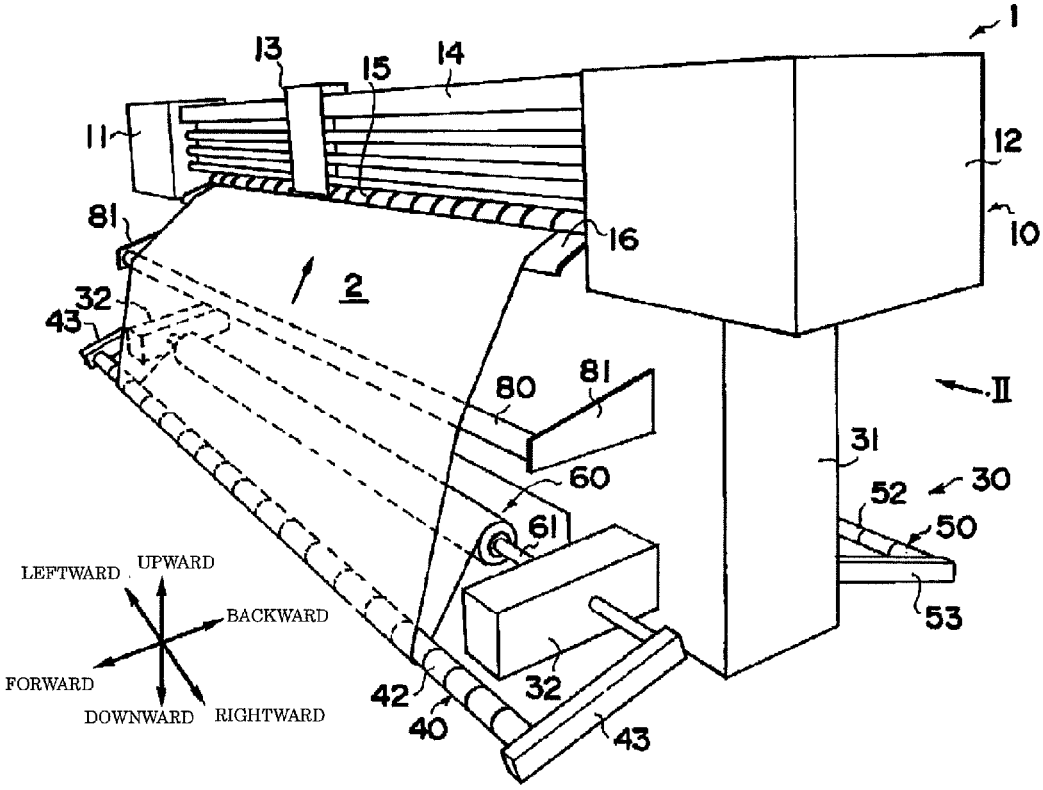
FIG. 1 is a perspective view showing a printer according to an embodiment of the present invention.

The embodiments will now be described with reference to the accompanying drawings, wherein like reference numerals designate corresponding or identical elements throughout the various drawings.

Hereinafter, a printer 1 according to an embodiment of the present invention will be described with reference to FIG. 1 through FIG. 4. For ease of explanation, leftward, rightward, forward (front), backward (rear), upward and downward directions are defined as the directions of arrows in FIG. 1. As shown in FIG. 1, the printer 1 is a printing apparatus for printing by ejecting liquid ink droplets to a sheet-like print medium 2 which is about 3 meter in the left-right (width) direction and which is carried in a state wound into a roll. The printer 1 includes a printing section 10 for conducting the printing process which is disposed in an upper portion of the printer 1 and a retaining section 30 which is disposed in a lower portion of the printer 1.

The printing section 10 mainly includes storage housings 11, 12, a print head 13, a guide rail 14, a holding member 15, and a platen 16. The storage housings 11, 12 are disposed on the left and right sides of the upper portion of the printer 1 to cover both ends of the guide rail 14. Installed in the storage housings 11, 12 are, for example, an operation panel for operating the printer 1, liquid ink to be ejected to the print medium 2, a maintenance station for conducting maintenance of the print head 13, but not shown.

The guide rail 14 extends in the left-right direction for a length longer than the width of the print medium 2 such that the left and right ends of the guide rail 14 are housed in the storage housings 11, 12. The guide rail 14 is provided with ridges and grooves which are formed in its front and rear surfaces to extend in the left-right direction for limiting movement in the forward, backward, upward and downward directions of the print head 13. The print head 13 has substantially an inverted U-like shape as seen from a right side, for example, and has a predetermined length in the left-right direction. The print head 13 is disposed to cover the upper surface and front and rear surfaces of the guide rail 14 and can be reciprocated in the left-right direction along the guide rail 14 extending in the left-right direction. The print head 13 has an ejection nozzles (not shown) for ejecting liquid ink droplets to the print medium 2 at a bottom portion of the print head 13 facing the platen 16.

Figure 2:
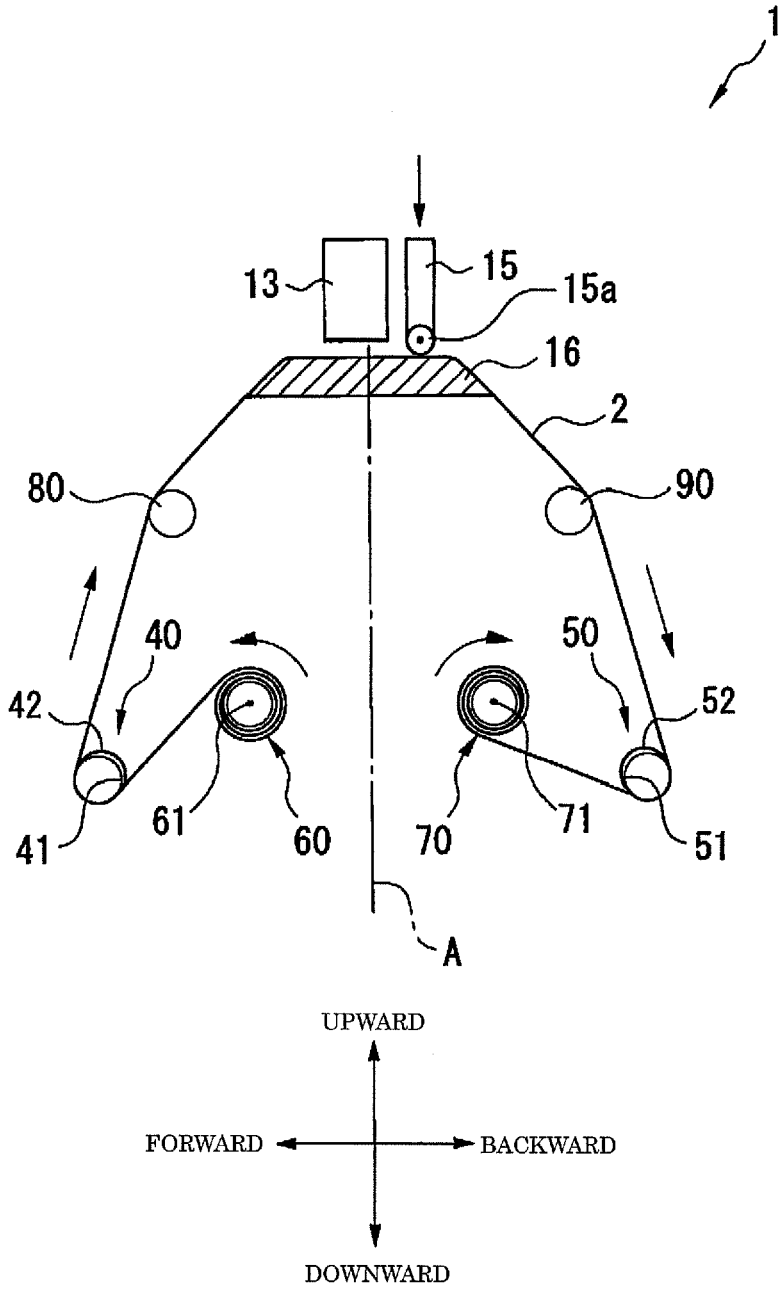
FIG. 2 is a schematic view, as seen from the right side, mainly showing a print medium.

The platen 16 extends in the left-right direction for a length longer than the width of the print medium 2 and is disposed below the print head 13. As shown in FIG. 2, the platen 16 has slant surfaces at its both ends in the forward-backward direction so as to facilitate the feeding and discharging of the print medium 2 and has a surface facing the print head 13, which is parallel with the lower surface of the print head 13. The holding member 15 extends in the left-right direction for a length longer than the width of the print medium 2 and is disposed below the guide rail 14. As shown in FIG. 2, the holding member 15 is positioned at the back of the print head 13 and has a rotational roller 15*a* at the lower end of the holding member 15. In addition, the holding member 15 is arranged movably in the upward-downward direction. Therefore, the holding member 15 moves downward so that the rotational roller 15*a* presses the print medium 2 on the platen 16 from above, thereby regulating the movement of the print medium 2 in the feeding direction.

As shown in FIG. 1, the retaining section 30 includes a pair of supporting members 32 and a pair of fixing arms 81 which are fixed to a front of a base 31, a sheet supplying member 60 of which both ends are supported by the pair of supporting members 32, a first guide member 40 supported by a pair of guide supporting arms 43 in front of the pair of supporting members 32, and a second guide member 80 held between the pair of fixing arms 81.

Further, the retaining section 30 has a symmetrical structure about a center line A extending in the upward-downward direction as shown in FIG. 2. That is, the first guide members 40 and 50, the sheet supplying member 60 and a sheet winding member 70, the second guide members 80 and 90 are placed symmetrically about the center line A, respectively, and the components of the first guide members 40 and 50 are the same and the components of the second guide members 80, 90 are the same. Therefore, the explanation about the structures of the first guide member 50 and the second guide member 90 will be omitted in the following description.

The base 31 is formed substantially in a rectangular parallelepiped extending in the left-right direction for a length longer than the width of the print medium 2 to support the printing section 10 which is arranged above the base 31. The pair of supporting members 32 are each formed substantially in a rectangular parallelepiped extending in the forward direction and the rear ends of the supporting members 32 are fixed to the base 31 at lower portions near the left and right ends of the base 31, respectively. The pair of fixing arms 81 are each formed in a plate shape extending in the forward direction and the rear ends of the pair of fixing arms 81 are fixed to the base 31 at portions substantially the same as the supporting members 32 in the left-right direction and above the pair of supporting members 32.

Figure 3:
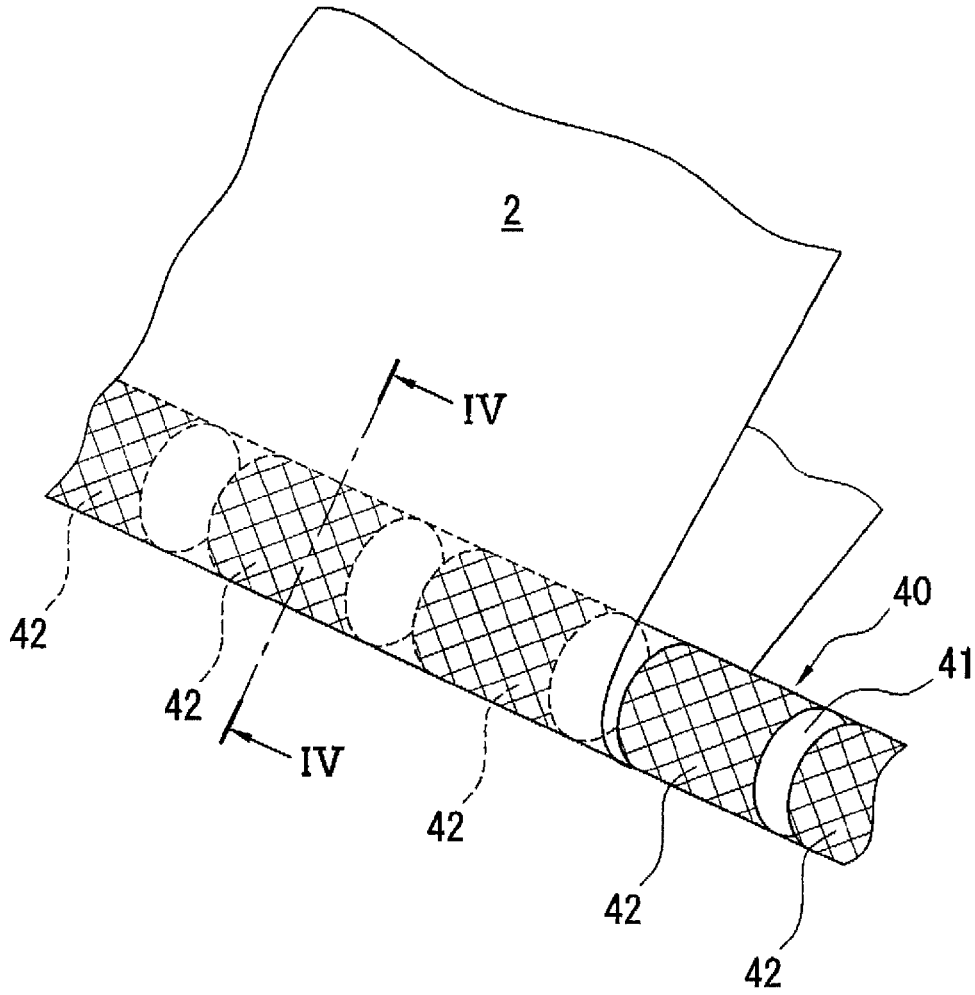
FIG. 3 is a perspective view showing a first guide member.

As shown in FIG. 1, the first guide member 40 extends in the left-right direction for a length longer than the width of the print medium 2. Further, as shown in FIG. 3, the first guide member 40 includes a guide bar 41 and a plurality of guide collars 42. The both ends of the guide bar 41 of the guide member 40 in the left-right direction are supported and fixed by the front ends of the pair of guide supporting arms 43. On the other hand, the rear ends of the pair of guide supporting arms 43 are rotatably supported by the pair of the supporting members 32. According to this structure, the first guide member 40 and the pair of guide supporting arms 43 supported by the pair of supporting members 32 can pivotally move in the upward-downward direction about the rear ends of the pair of guide supporting arms 43.

Figure 4:
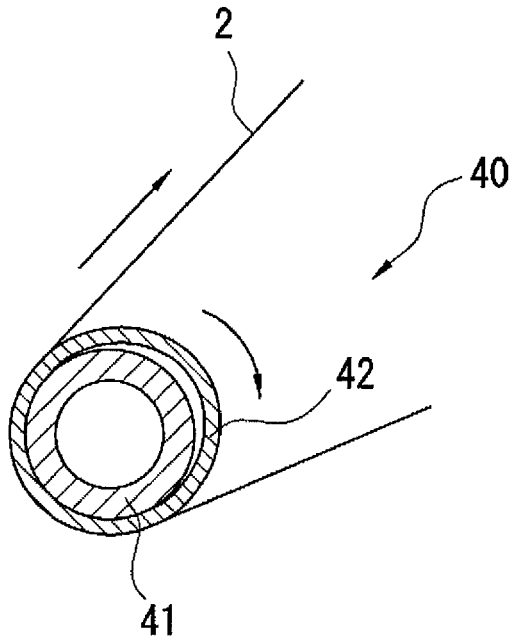
FIG. 4 is a sectional view taken along a line IV-IV in FIG. 3.
Figure 5:
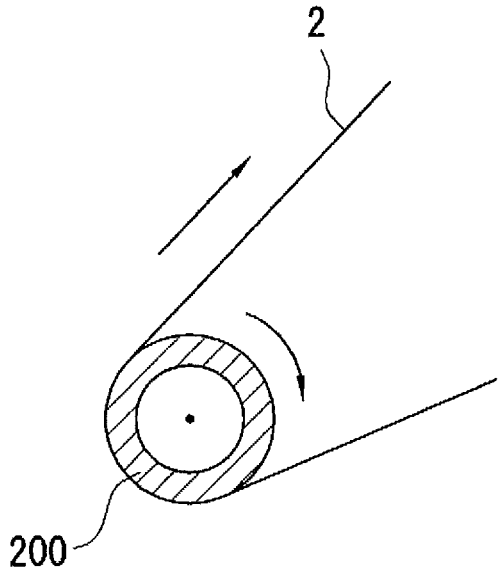
FIG. 5 BACKGROUND ART
FIG. 5 is a sectional view showing a conventional guide bar.

As shown in FIG. 4, the guide bar 41 is made of, for example, a metallic material to have a cylindrical shape, i.e. a rod-like shape extending in the left-right direction and has a smooth peripheral surface. Each guide collar 42 is made of, for example, a plastic resin to have a cylindrical shape having a predetermined length in the left-right direction, has a meshed outer surface, and is deformable by external force. As shown in FIG. 4, since the inner diameter of the guide collar 42 is larger than the outer diameter of the guide bar 41, the guide collar 42 is rotatable relative to the outer surface of the guide bar 41. Since the length in the left-right direction of the guide collar 42 is smaller than the length of the guide bar 41, a plurality of guide collars 42 are aligned in the left-right direction on the periphery of the guide bar 41 to cover the periphery of the guide bar 41.

The sheet supplying member 60 has a sheet supplying shaft 61 extending in the left-right direction onto which the print medium 2 unprinted is wound. The ends in the left-right direction of the sheet supplying shaft 61 are rotatably supported by the pair of supporting members 32. At the portions of the sheet supplying shaft 61 supported by the pair of supporting members 32, it is configured to apply rotational force to the sheet supplying shaft 61 and to brake the sheet supplying shaft 61 to prevent the sheet supplying shaft 61 from freely rotating.

The sheet winding member 70 includes a sheet winding shaft 71 extending in the left-right direction onto which the print medium 2 printed is wound. The ends in the left-right direction of the sheet winding shaft 71 are rotatably supported by a pair of supporting members (not shown). Similarly to the sheet supplying member 60 as mentioned above, at the portions of the sheet winding shaft 71 supported by the pair of supporting members, it is configured to apply rotational force to the sheet winding shaft 71 and to brake the sheet winding shaft 71 to prevent the sheet winding shaft 71 from freely rotating.

The second guide member 80 is made of, for example, a metallic material to have a cylindrical shape extending in the left-right direction for a length longer than the width of the print medium 2 and has a smooth peripheral surface. The second guide member 80 is placed at such a position as to smoothly introduce the print medium 2 to the slant surface of the platen 16.

The structure of the printer 1 has been described above. Hereinafter, the feeding of the print medium 2 will be described.

First, the order of feeding the print medium 2 will be described. As shown in FIG. 2, the print medium 2 supplied from the sheet supplying member 60 advances to the first guide member 40, then advances from the first guide member 40 to the second guide member 80, and is introduced onto the platen 16 after changing its advancing angle by the surface of the second guide member 80. After that, the print medium 2 on the platen 16 after printed is wound onto the sheet winding member 70 via the second guide member 90 and the first guide member 50.

As shown in FIG. 2, the print head 13 is reciprocated in the left-right direction and ejects liquid ink droplets from the bottom of the print head 13 so as to print on the print medium 2 positioned on the platen 16. During this printing process, the sheet supplying shaft 61 of the sheet supplying member 60 is braked and is thus regulated its rotation and the rotational roller 15*a* of the holding member 15 presses the print medium 2 on the platen 16 from above, thereby regulating the movement of the print medium 2 in the feeding direction between the sheet supplying member 60 and the rotational roller 15*a*. Further, the first guide member 40 and the pair of guide supporting arms 43 pivotally move downwards under their own weight, thereby applying a certain tension in the feeding direction on the print medium 2 between the sheet supplying member 60 and the rotational roller 15*a*. Accordingly, the print medium 2 on the platen 16 is prevented from slacking, thereby enabling higher-accuracy printing.

When the print medium 2 is fed in the feeding direction by a predetermined distance from the state as shown in FIG. 2 to print on another portion, the holding member 15 is first moved upward to allow the print medium 2 to be fed. After that, the sheet supplying shaft 61 of the sheet supplying member 60 is rotated so as to discharge the print medium 2 just for the predetermined distance and the sheet winding shaft 71 of the sheet winding member 70 is rotated so as to wind up the print medium 2 just for the same predetermined distance as the distance fed at the sheet supplying member 60. Then, the rotational roller 15*a* presses the print medium 2 on the platen 16 from above. During this, constant tension is always applied to the print medium 2 in the feeding direction and the direction opposite to the feeding direction by the first guide member 40 and the pair of guide supporting arms 43, and the first guide member 50 and the pair of guide supporting arms 53. After that, the rotational roller 15*a* presses the print medium 2 on the platen 16 so as to regulate the movement in the feeding direction of the print medium 2 between the sheet supplying member 60 and the rotational roller 15*a* of the holding member 15, and the print head 13 is reciprocated in the left-right direction to print. In this manner, intended printing is conducted by repeating the feeding of the print medium 2 and the printing by the print head 13.

In the first guide member 40, the both ends of the guide bar 41 are fixed not to rotate by the pair of the guide supporting arms 43 during the feeding of the print medium 2. Further, the periphery of the guide bar 41 has a smooth surface as compared to the surface of the print medium 2. Therefore, as shown in FIG. 4, the plural guide collars 42 and the print medium 2 can rotate together without slippage therebetween relative to the periphery of the guide bar 41 according to the feeding of the print medium 2. Similarly, in the first guide member 50 having the same structure as the first guide member 40, the guide collars 52 and the print medium 2 can rotate together without slippage therebetween relative to the periphery of the guide bar 51.

According to this structure, the feeding distance of the print medium 2 from the sheet supplying member 60 in the feeding direction and the feeding distance of the print medium 2 at a position corresponding to the print head 13 are set equal, thereby improving the accuracy in feeding the print medium 2. In addition, since the print medium 2 can be fed with the guide bar 41 being in the fixed state i.e. without rotation of the guide bar 41, the feeding of the print medium 2 is not affected by the wavy rotational trajectory of the periphery of the guide member 41 which is caused during the feeding of the print medium 2 by the rotation of the guide bar 41 as the prior art. Therefore, at any position in the left-right direction of the print medium 2, the print medium can be fed for the same distance, thereby improving the accuracy in feeding the print medium 2.

Since the plural guide collars 42 are adapted to rotate with the print medium 2 relative to the periphery of the guide bar 41 during the feeding of the print medium 2, the plural guide collars 42 can rotate with the print medium 2 relative to the periphery of the guide bar 41 at respective different speeds. Therefore, the print medium 2 can be fed for the same distance at any position in the left-right direction without being affected by twist and warpage occurred in manufacturing the guide bar 41 or an installation error occurred in installing the guide bar 41 to the printer 1, thereby improving the accuracy in feeding the print medium 2.

Also in the first guide member 50, the plural guide collars 52 are adapted to rotate with the print medium 2 relative to the periphery of the guide bar 51 during the feeding of the print medium 2, the print medium 2 can be fed for the same distance at any position in the left-right direction without being affected by twist and warpage occurred in manufacturing the guide bar 51 or an installation error occurred in installing the guide bar 51 to the printer 1, thereby enabling the print medium 2 printed to be wound up with the print medium 2 being uniform in the left-right direction.

Since this embodiment is the printer 1 for printing on the print medium 2 having a long width about 3 meters, the printer 1 is required to include the guide bar 41 extending in the left-right direction for a length longer than the width of the print medium 2. The feeding accuracy can be improved by an inexpensive and easy method of covering the guide bar 41 with the plural guide collars 42 of which cost is lower than the cost for manufacturing a guide bar 41 which extend exactly straight for the purpose of improving the feeding accuracy.

In the aforementioned embodiment, the plural guide collars 42 are preferably arranged to be spaced from each other in the left-right direction to allow the guide collars 42 to freely rotate relative to each other around the guide bar 41. Further, the covered periphery of the guide bar 41 may depend on the width of the print medium 2 and may not be the whole.

In the aforementioned embodiment, there is no particular limitation on the number of the guide collars 42 to be mounted on the guide bar 41 and on the size of each guide collar 42 in the left-right direction.

In the aforementioned embodiment, the printer 1 according to the embodiment of the present invention can print on a print medium 2 having a net-like structure.

In the aforementioned embodiment, a member for holding the print medium 2 on the platen 16 is not limited to the holding member 15. For example, an arrangement in which the platen 16 has plural vacuum holes and air is sucked through the plural vacuum holes so as to hold the print medium 2 on the platen 16 may be employed.

In the printer according to the embodiment of the present invention, since the guide member includes a guide bar which is formed in a cylindrical shape extending in the width direction and a guide collar which is formed in a cylindrical shape coaxially with the guide bar to cover the periphery of the guide bar and which can freely rotate relative to the guide bar, the guide collar can rotate with the print medium relative to the surface of the guide bar during the feeding of the print medium in the predetermined direction so that the feeding of the print medium is not affected by the wavy rotational trajectory which is caused by the rotation of the guide bar, thereby improving the accuracy in feeding the print medium. Further, the rotation of the guide bar is stopped during the feeding of the print medium. Since the guide bar is stopped from rotating, the feeding of the print medium can be prevented from being affected by twist and warpage occurred in the guide member as mentioned above as the prior art.

Since the guide member includes a plurality of guide collars each of which is formed in a cylindrical shape coaxially with the guide bar to cover the periphery of the guide bar and can freely rotate relative to the guide bar such that the plurality of guide collars are aligned in the width direction, the plural guide collars rotate with the print medium relative to the surface of the guide bar, whereby twist and warpage occurred in manufacturing the guide bar or an installation error occurred in installing the guide bar to the printer can be absorbed by the relative rotation of the plural guide collars at respective different speeds, thereby improving the accuracy in feeding the print medium.

Furthermore, since the guide member is supported at its both ends by supporting arms which are pivotally movable in the upward-downward direction so that the print medium is held in the tensioned state by the pivotal movement of the guide member in the upward-downward direction because of its own weight, the feeding distance of the print medium from the sheet supplying member in the feeding direction and the feeding distance of the print medium at a position corresponding to the print head are set equal so as to prevent the print medium from slacking in the predetermined direction, thereby improving the accuracy in feeding the print medium.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A printer comprising:

a platen configured to support a sheet print medium on an upper surface of the platen, the sheet print medium having a width direction;

a print head provided to print on the sheet print medium fed onto the upper surface of the platen; and a guide member configured to guide the sheet print medium to feed the sheet print medium onto the upper surface of the platen, the guide member comprising:

a plurality of guide collars having a substantially cylindrical shape around which the sheet print medium is wound; and a guide bar having a substantially cylindrical shape in extending the width direction, and provided in the plurality of guide collars, an inner diameter of each of the plurality of guide collars being larger than an outer diameter of the guide bar so that the plurality of guide collars are rotatable around the guide bar, wherein an inner surface of each of the plurality of guide collars is in direct contact with an outer surface of the guide bar, and wherein each of the plurality of guide collars is arranged to be spaced from a guide collar provided next to the each of the plurality of guide collars and freely rotate relative to each other around the guide bar, which is provided not to be rotatable around a center axis of the guide bar.

2. The printer according to claim 1, wherein the guide member is provided so that a weight of the guide member provides tension to the sheet print medium.

3. The printer according to claim 1, further comprising, a holding member configured to hold the sheet print medium on the upper surface of the platen.

4. The printer according to claim 1, wherein the guide bar is made from metal.

5. The printer according to claim 1, wherein the plurality guide collars are made from resin.

6. The printer according to claim 1, wherein each of the plurality of guide collars has a meshed outer surface.

7. The printer according to claim 1, wherein the platen has a longitudinal direction, and wherein the plurality of guide collars and the guide bar have an axial direction substantially parallel to the longitudinal direction.

8. The printer according to claim 1, wherein the sheet print medium is wound around a lower part of each of the plurality of guide collars.

9. The printer according to claim 1, wherein a first end portion of the guide bar is supported by a first arm, a second end portion of the guide bar is supported by a second arm, and the first and second arms are rotatable around a rotational axis.

10. The printer according to claim 1, wherein a first end portion of the guide bar is supported by a first arm, a second end portion of the guide bar is supported by a second arm, and the first and second arms are rotatable around a rotational axis having a direction substantially parallel to the width direction, so that the guide member and the first and second arms are pivotally movable in an upward-downward direction around the rotational axis.

* * * * *